US008451101B2

(12) United States Patent
Somasundaram et al.

(10) Patent No.: US 8,451,101 B2
(45) Date of Patent: May 28, 2013

(54) SPEECH-DRIVEN PATIENT CARE SYSTEM WITH WEARABLE DEVICES

(75) Inventors: Prakash Somasundaram, Pittsburgh, PA (US); Amar Kapadia, Pittsburgh, PA (US)

(73) Assignee: Vocollect, Inc., Pittsburgh, PA (US)

( * ) Notice: Subject to any disclaimer, the term of this patent is extended or adjusted under 35 U.S.C. 154(b) by 789 days.

(21) Appl. No.: 12/548,498

(22) Filed: Aug. 27, 2009

(65) Prior Publication Data

US 2010/0052871 A1 Mar. 4, 2010

Related U.S. Application Data

(60) Provisional application No. 61/092,641, filed on Aug. 28, 2008.

(51) Int. Cl.
*G08B 5/22* (2006.01)

(52) U.S. Cl.
USPC ..... 340/286.07; 340/539.11; 340/539.18; 340/539.12; 455/575.2; 607/60

(58) Field of Classification Search
USPC ..... 340/539.13, 539.11, 539.12, 539.18, 340/573.1, 10.1, 573.4, 539.17, 286.07, 5.8; 455/575.2; 600/301, 509, 300, 508; 705/2; 715/718, 827; 607/60
See application file for complete search history.

(56) References Cited

U.S. PATENT DOCUMENTS

| | | | | |
|---|---|---|---|---|
| 4,213,253 A | | 7/1980 | Gudelis | |
| 5,077,666 A | | 12/1991 | Brimm et al. | |
| 5,465,082 A | * | 11/1995 | Chaco | 340/539.13 |
| 5,536,084 A | | 7/1996 | Curtis et al. | |
| 5,754,111 A | | 5/1998 | Garcia | |
| 5,822,544 A | * | 10/1998 | Chaco et al. | 705/2 |
| 5,838,223 A | | 11/1998 | Gallant et al. | |

(Continued)

FOREIGN PATENT DOCUMENTS

| | | |
|---|---|---|
| EP | 1791053 | 5/2007 |
| WO | WO9525326 | 9/1995 |
| WO | WO02096126 | 11/2002 |
| WO | WO2005043303 | 5/2005 |

OTHER PUBLICATIONS

Forty-Seven-page "The Digital Consumer Technology Handbook", A Comprehensive Guide to Devices, Standards, Future Directions, and Programmable Logic Solutions; by Amit Dhir, Xilinx, Inc. dated Feb. 27, 2004.

*Primary Examiner* — Hoi Lau
(74) *Attorney, Agent, or Firm* — Wood, Herron & Evans, LLP

(57) ABSTRACT

Embodiments of the invention provide a communication system for care providers and a method of managing patient care utilizing same. The system comprises a patient communication unit configured to be positioned proximate to a patient and operable to capture a patient call that includes speech input of the patient, a central console communicably coupled with the patient communication unit for receiving the call from the patient communication unit, and a portable communication unit configured to be carried by a care provider and communicably coupled with the central console, the portable communication unit operable to receive the call from the central console, to capture speech input of the care provider, and to play at least a portion of the patient speech input, the portable communication unit further operable to convert at least a portion of the care provider speech input into at least one command associated with the call.

28 Claims, 9 Drawing Sheets

U.S. PATENT DOCUMENTS 5,877,675 A * 3/1999 Rebstock et al. ..... 340/286.07
5,986,568 A 11/1999 Suzuki
D420,674 S 2/2000 Powell
6,057,758 A * 5/2000 Dempsey et al. ..... 340/539.12
6,292,783 B1 9/2001 Rohler et al.
6,442,432 B2 * 8/2002 Lee ..... 607/59
6,591,242 B1 7/2003 Karp et al.
6,714,913 B2 3/2004 Brandt
6,720,864 B1 4/2004 Wong et al.
6,747,556 B2 6/2004 Medema et al.
6,772,454 B1 8/2004 Barry
6,849,045 B2 2/2005 Iliff
6,872,080 B2 3/2005 Pastrick
6,890,273 B1 5/2005 Perez
7,056,289 B2 * 6/2006 Kasper et al. ..... 600/300
7,065,381 B2 6/2006 Jenkins
7,088,233 B2 * 8/2006 Menard ..... 340/539.1
7,092,376 B2 * 8/2006 Schuman ..... 370/349
7,136,684 B2 * 11/2006 Matsuura et al. ..... 455/575.2
7,154,397 B2 * 12/2006 Zerhusen et al. ..... 340/573.1
7,228,429 B2 6/2007 Monroe
7,263,669 B2 * 8/2007 Denholm ..... 715/827
7,283,845 B2 10/2007 De Bast
7,287,031 B1 10/2007 Karpf
D568,881 S 5/2008 Hsiau
D569,358 S 5/2008 Devenish, III et al.
D569,876 S 5/2008 Griffin
D573,577 S 7/2008 Huang
D583,827 S 12/2008 Wahl
7,487,101 B1 * 2/2009 Vasko et al. ..... 705/3
7,574,370 B2 8/2009 Mayaud
7,598,852 B2 * 10/2009 Chriss ..... 340/4.13
7,598,853 B2 * 10/2009 Becker et al. ..... 340/539.13
D609,246 S 2/2010 Wahl
7,664,657 B1 2/2010 Letzt et al.
7,706,878 B2 * 4/2010 Freeman ..... 607/6
7,868,740 B2 * 1/2011 McNeely et al. ..... 340/286.07
7,912,733 B2 * 3/2011 Clements et al. ..... 705/2
7,978,062 B2 * 7/2011 LaLonde et al. ..... 340/539.11
8,054,177 B2 * 11/2011 Graves et al. ..... 340/539.12
2002/0004729 A1 1/2002 Zak et al.
2002/0044043 A1 * 4/2002 Chaco et al. ..... 340/286.07
2002/0101349 A1 * 8/2002 Rojas, Jr. ..... 340/573.1
2002/0146096 A1 10/2002 Agarwal et al.
2002/0183598 A1 * 12/2002 Teraura et al. ..... 600/300
2003/0050539 A1 * 3/2003 Naghavi et al. ..... 600/300
2003/0130016 A1 * 7/2003 Matsuura et al. ..... 455/569
2003/0160682 A1 * 8/2003 Yamada et al. ..... 340/286.02
2004/0034286 A1 * 2/2004 Kasper et al. ..... 600/300
2004/0122486 A1 * 6/2004 Stahmann et al. ..... 607/60
2004/0122488 A1 * 6/2004 Mazar et al. ..... 607/60
2004/0220686 A1 11/2004 Cass
2005/0033127 A1 * 2/2005 Ciurczak et al. ..... 600/316
2005/0148890 A1 * 7/2005 Hastings ..... 600/509
2005/0192845 A1 * 9/2005 Brinsfield et al. ..... 705/3
2005/0228245 A1 * 10/2005 Quy ..... 600/301
2005/0251213 A1 * 11/2005 Freeman ..... 607/5
2006/0026035 A1 * 2/2006 Younkes et al. ..... 705/2
2006/0253281 A1 * 11/2006 Letzt et al. ..... 704/231
2006/0279427 A1 * 12/2006 Becker et al. ..... 340/573.4
2006/0286960 A1 * 12/2006 Goehler ..... 455/403
2006/0287014 A1 * 12/2006 Matsuura et al. ..... 455/575.2
2007/0080801 A1 * 4/2007 Weismiller et al. ..... 340/539.13
2007/0221138 A1 9/2007 Mainini et al.
2007/0247310 A1 * 10/2007 Ulrich et al. ..... 340/540
2007/0276270 A1 * 11/2007 Tran ..... 600/508
2007/0299473 A1 * 12/2007 Matos ..... 607/5
2008/0018480 A1 * 1/2008 Sham ..... 340/573.1
2008/0055071 A1 * 3/2008 Chriss ..... 340/539.12
2008/0072153 A1 * 3/2008 Yang ..... 715/718
2008/0072847 A1 3/2008 Liao
2008/0082363 A1 * 4/2008 Habashi ..... 705/2
2008/0106374 A1 * 5/2008 Sharbaugh ..... 340/5.8
2008/0164998 A1 * 7/2008 Scherpbier et al. ..... 340/539.13
2008/0211665 A1 * 9/2008 Mazar et al. ..... 340/539.17
2008/0224861 A1 * 9/2008 McNeely et al. ..... 340/540
2008/0262867 A1 * 10/2008 Bayne et al. ..... 705/2
2008/0262873 A1 * 10/2008 Bayne et al. ..... 705/3
2008/0306740 A1 * 12/2008 Schuck et al. ..... 704/275
2008/0316036 A1 * 12/2008 Nixon ..... 340/573.1
2009/0063183 A1 * 3/2009 McNeely et al. ..... 705/2
2009/0063193 A1 * 3/2009 Barton et al. ..... 705/3
2009/0216534 A1 8/2009 Somasundaram
2009/0222065 A1 * 9/2009 Dlugos et al. ..... 607/60
2009/0322514 A1 * 12/2009 Monroe ..... 340/539.13
2010/0001838 A1 * 1/2010 Miodownik et al. ..... 340/10.1
2010/0036667 A1 2/2010 Byford et al.
2010/0121157 A1 * 5/2010 Espina et al. ..... 600/301
2010/0198608 A1 * 8/2010 Kaboff et al. ..... 705/2

* cited by examiner

SPEECH-DRIVEN PATIENT CARE SYSTEM WITH WEARABLE DEVICES

CROSS-REFERENCE TO RELATED APPLICATION

This application is related to and claims the benefit of U.S. Provisional Application No. 61/092,641 to Prakash Somasundaram et al., entitled "SPEECH-DRIVEN PATIENT CARE SYSTEM WITH WEARABLE DEVICES", filed Aug. 28, 2008, which application is incorporated by reference herein.

FIELD OF THE INVENTION

Embodiments of the invention relate generally to a speech-driven patient care system as well as a mobile or portable communication units used therein.

BACKGROUND OF THE INVENTION

Within a patient facility, such as a hospital, nursing home, etc., care providers, such as nurses, physicians, and assistants are valuable assets whose time must be allocated in an efficient manner for proper patient care and patient satisfaction. In the facility, a staff of nurses and other care providers are usually assigned a series of patients in individual rooms to whom they provide care. To that end, nurse call systems may be used provide a line of communication between the patient in a room and a nurse or other care provider.

One common nurse call system has a call button that is located in the patient's room and is accessible by the patient. When the button is pressed, a light outside the patient's room and/or an indicator light at a staff desk is typically turned on to visually indicate the request for help from the patient. This "patient call" is attended to if and when a nurse notices either the light outside the patient's room and/or at the staff desk. As may be appreciated, a significant amount of time might elapse from when the patient initiates the call and when the nurse actually responds.

In other nurse call systems, the patient presses a button to initiate two-way full duplex voice communications with a nurse station. The button is typically a call button, and the nurse then calls back to the patient to talk to them in an attempt to understand the problem before attending to the call. While such a system may provide more immediate attention to the patient's call, it is often disruptive and does not allow the nurse to prioritize or organize the call with respect to its urgency or the time of attention needed.

In still other nurse call systems, devices such as pagers, phones, and/or other telecommunications devices are integrated into the system. As such, the system sends out an alphanumeric message to the nurse that is wearing the pager, phone and/or telecommunications device or carrying the phone in response to receiving a patient call. However, as with call systems that utilize full duplex voice communications, until the nurse makes a call to the room, they do not know what the request or call was for and who needs to attend to it.

Thus, it is typical that nurse call systems require some immediate two-way voice communications to provide the nurse with an indication of what is needed by the patient. This is disruptive to the nurse or other care provider, as they may be in the middle of assisting another patient, performing a task, or otherwise unavailable. Thus, such systems are generally inefficient. Therefore, there is still a need in the art to improve upon the communication between a patient and a nurse or care provider that tends to them.

SUMMARY OF THE INVENTION

Embodiments of the invention provide a communication system for care providers and a method of managing patient care utilizing same. The system comprises a patient communication unit configured to be positioned proximate to a patient and operable to capture a patient call that includes speech input of the patient, a central console communicably coupled with the patient communication unit for receiving the call from the patient communication unit, and a portable communication unit configured to be carried by a care provider and communicably coupled with the central console, the portable communication unit operable to receive the call from the central console, to capture speech input of the care provider, and to play at least a portion of the patient speech input, the portable communication unit further operable to convert at least a portion of the care provider speech input into at least one command associated with the call.

These and other advantages will be apparent in light of the following figures and detailed description.

It should be understood that the appended drawings are not necessarily to scale, presenting a somewhat simplified representation of various preferred features illustrative of the basic principles of embodiments of the invention. The specific design features of the system and/or sequence of operations as disclosed herein, including, for example, specific dimensions, orientations, locations, and shapes of various illustrated components, will be determined in part by the particular intended application and use environment. Certain features of the illustrated embodiments may have been enlarged, distorted or otherwise rendered differently relative to others to facilitate visualization and clear understanding.

DETAILED DESCRIPTION OF THE INVENTION

Figure 1:
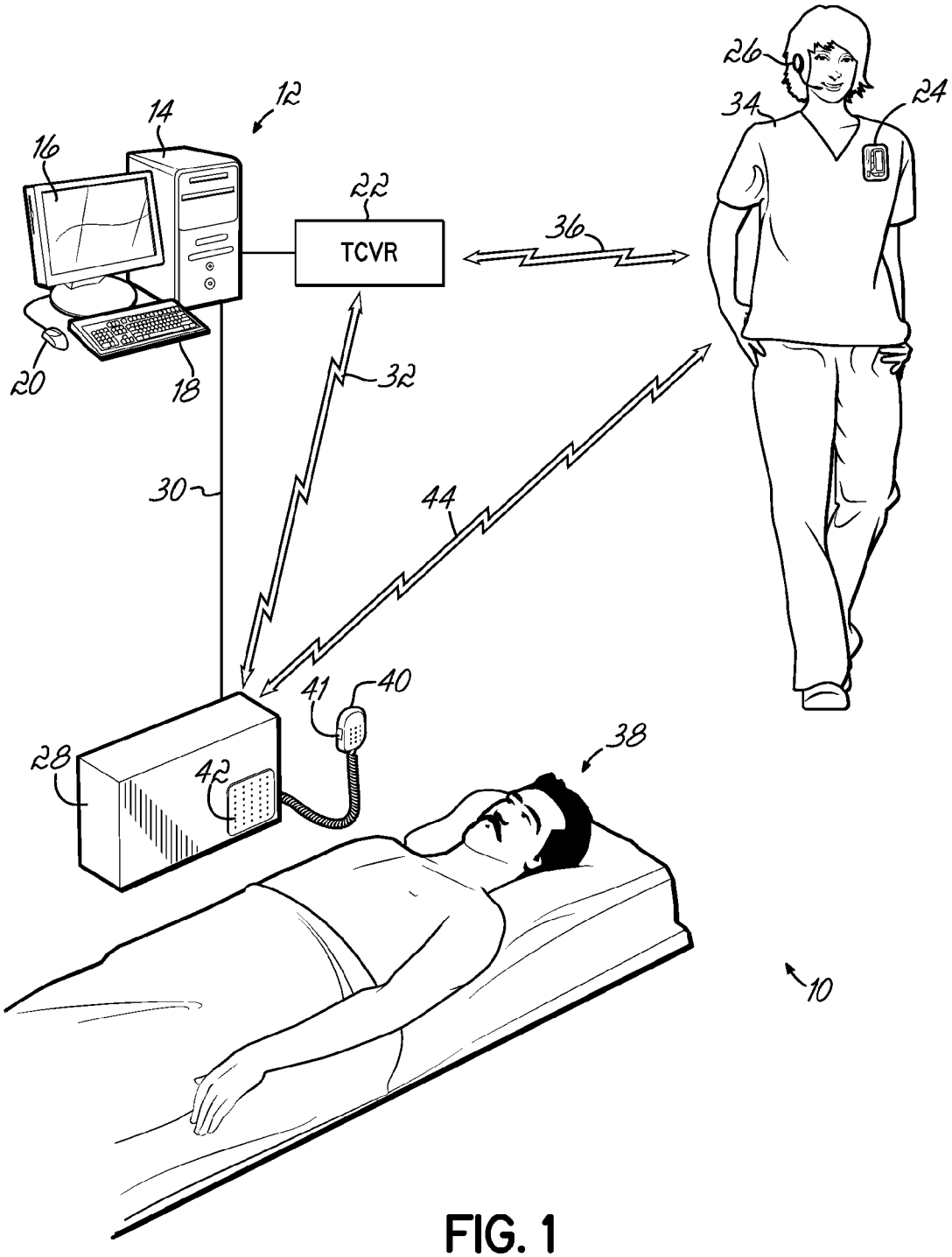
FIG. 1 is a diagrammatic illustration of a communication system consistent with embodiments of the invention.

FIG. 1 illustrates a schematic view of a communication system for care providers 10 (hereinafter, a "patient care system" 10, or more simply, "system" 10) consistent with embodiments of the invention. Patient care system 10 includes a central console 12 utilized for managing care providers (e.g., nurses, assistants, technicians, healthcare professionals, physicians, surgeons, and/or other care providers), managing patient care regimens, and capturing and storing data associated therewith. Central console 12 (or, more simply, "console" 12), in specific embodiments, may be at least one computer, computer system, computing device, server, disk array, or programmable device such as a multi-user computer, a single-user computer, a handheld device, and/or a networked device (including a computer in a cluster configuration). As such, console 12 may be configured to integrate with a nurse call system and provide direct communication between a central area or office, as well as individual patient rooms, surgical facilities, and/or other care facilities.

Generally, the central console 12 includes at least one processing unit (not shown) coupled to a memory (not shown). Each processing unit is typically implemented in hardware using circuit logic disposed in one or more physical integrated circuit devices, or chips. Each processing unit may be one or more microprocessors, micro-controllers, field programmable gate arrays, or ASICs, while the memory may include random access memory (RAM), dynamic random access memory (DRAM), static random access memory (SRAM), flash memory, and/or another digital storage medium, and also typically implemented using circuit logic disposed on one or more physical integrated circuit devices, or chips. The console 12 may further include a monitor 16 and one or more input devices, such as a keyboard 18 and/or mouse 20, to interface with a user (e.g., a care provider). Moreover, the console 12 may include transceiver circuitry 22 for communicably coupling to remote devices, such as a portable communication unit in the form of a badge 24 or headset 26 utilized to communicate with care providers, as well as a patient communication unit 28 (or patient communication "terminal" 28) configured in one or more patient rooms. In particular, the console 12 is communicably coupled with a unit 28 through a wired link as at 30 or a wireless link as at 32. Central console 12 is communicably coupled with the badge 24 and/or headset 26 of a care provider 34 through a wireless link as at 36. Hereinafter, the care provider 34 will be generically referred to as a user 34. Additionally, the person proximate the unit 28 or who is tended to by one or more users 34 will be generically referred to as a patient 38.

The unit 28 may be operated by a patient 38 and include circuitry to communication with the console 12 (e.g., such as circuitry to communicate through connection 30 and/or transceiver circuitry to communicate wirelessly through connection 32, neither shown), as well as a microphone 40 activated by a button 41 and a speaker 41. In some embodiments, the patient 38 communicates with the console 12 through the unit 28. In particular, the patient 38 may provide speech input that is captured by the microphone 40 of the unit 28. The call from the patient 38, and in particular the speech input of the patient 38, may then be provided, along with additional information (e.g., such as the location of the patient 38 and/or an identity of the patient 38), through console 12 and/or transceiver circuitry 22, to the user 34. In some embodiments, the user 34 may respond through their own speech input, which may include a command and/or message for the patient 38. In particular, the user 34 may respond through console 12, to unit 28. Alternatively, the user 34 may respond to the unit 28 directly through a wireless link as at 44.

Figure 2:
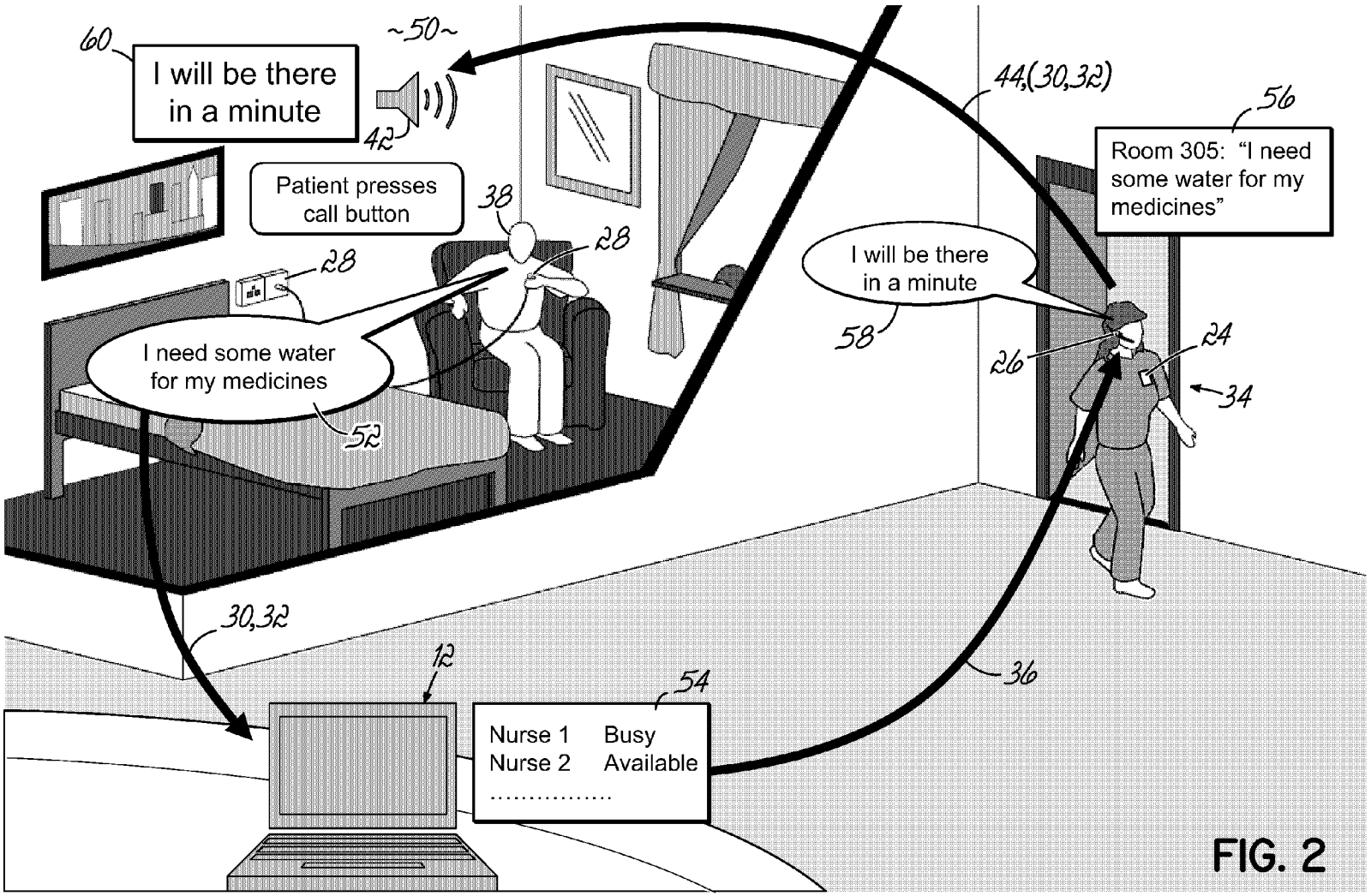
FIG. 2 is a graphical illustration showing the flow patient calls through the system of FIG. 1.

FIG. 2 is a schematic view illustrating features of the present invention directed to handling of a patient call. A patient 38 in a patient room 50 may engage a patient communication unit 28 by pressing a call button 41 that allows the patient to speak into the microphone 40. The patient generates a call 52, which is shown in FIG. 2 as including the speech input, "I need some water for my medicines." The call is sent from the unit 28 to the central console 12. In some embodiments, the central console 12 may be aware of the status of each of the users 34 in the system 10. Such awareness may be provided by information regarding the event schedules for the users 34, their real-time activity as reported back to the central console 12, as well as their room assignments. In some embodiments, this information may be analyzed to determine the current status of a user 34 and/or whether that user 34 should be sent a call, or even whether the user 34 should be sent a call from a particular patient 38.

For example, and as illustrated in a graphic representation 54 associated with the central console 12 and/or system 10, embodiments of the invention may evaluate the availability of various users 34, indicated as Nurse 1, Nurse 2, etc. As shown in FIG. 2, Nurse 1 may be the primary care provider for the patient 38 in a room 50. However, the central console 12 may determine that Nurse 1 is busy, and thus, embodiments of the invention may transfer the call to the first available care provider, who happens to be Nurse 2. A particular hierarchy might be managed by the central console 12 to insure proper flow of calls or voice messages to the users 34. While central console 12 might automatically be able to handle the transfer of the call, the hierarchy of transfer may instead be managed by a nursing manager, a scheduler, or another person manning the central console 12, or a user 34 in contact with the central console 12 with the responsibility to schedule or assign calls. In some embodiments, the hierarchy may be based on who is currently working, who is available for tasks, seniority, and/or another factor.

Once the user 34 associated with a call is determined, the call may be transmitted via link 36 to that user 34. Speech input of the patient 38 included with the call may then be played with an indication of the room and/or patient of origin (block 56). User 34 may be carrying a headset 26 and/or a badge 24 that provides the hardware for communicating with the central console 12 and/or the patient communication unit 28 consistent with embodiments of the invention. For example, the headset 26 and/or badge 24 may include a speaker for playing the patient speech input 56, and a microphone for capturing speech input of the user 34 (e.g., a "response") (block 58). For example, and as illustrated in FIG. 2, a user 34 may respond immediately to a call from a patient 38 in their response 58. At least a portion of that response 58 may be provided to the patient communication unit 28 back in the patient's room and played through speaker 42 as a reply voice message 60. The response 58 might be provided back to the unit 28 via the central console 12 utilizing the connections 36, 30, and/or 32. Alternatively, the response 58 may be provided directly to the patient communication unit 28 via wireless link 44. Therefore, while the response 58 is shown traveling directly back to the patient room 50, it may take a more circuitous route through the communications links 30, 32, 36 and/or 44.

In the example illustrated in FIG. 2, the user 34 responds directly to the patient 38 upon receiving the patient call. However, in accordance with one feature of the present invention, the user 34 does not have to answer directly back to the patient 38, but rather may utilize a voice command to perform an action related to a call. For example, the user 34 may prioritize the call, transfer calls to at least one other user, and/or perform additional actions related to the call utilizing voice commands in a hands-free manner. To that end, and consistent with another aspect of embodiments of the invention, the badge 24 and/or headset 26 (e.g., "device" 24 and/or 26) may include speech recognition functionality to allow the user 34 to control how a call is handled.

Figure 3:
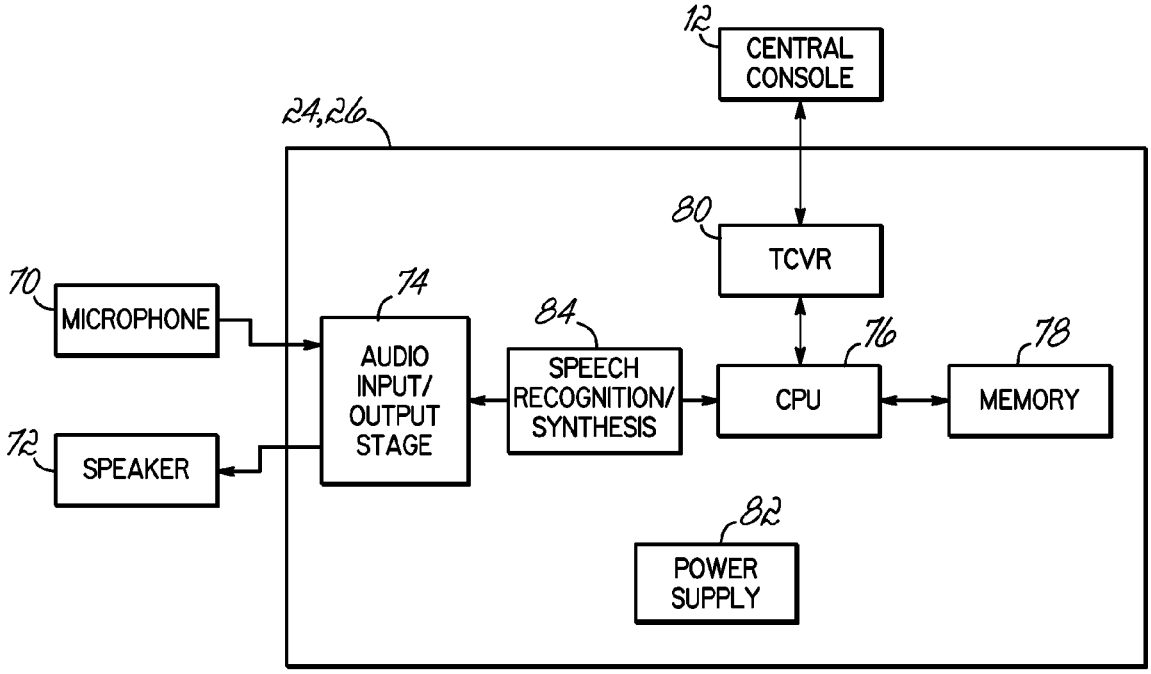
FIG. 3 is a diagrammatic illustration of components of a headset and/or badge of FIG. 1.

FIG. 3 illustrates a schematic block diagram of some of the basic components for the device 24 and/or 26 worn by the user 34 as illustrated in FIGS. 1 and 2. Specifically, the device 24 and/or 26 may include a microphone 70 and speaker 72 to capture speech input of the user 34 and play audio for the user 34 consistent with the embodiments of the invention. To that end, the device 24 and/or 26 may include an audio input/output stage 74 for interfacing with the microphone 70 and speaker 72. The device 24 and/or 26 may further include at least one processing unit, or CPU 76, which may be coupled to a memory 78. Each CPU 76 is typically implemented in hardware using circuit logic disposed in one or more physical integrated circuit devices, or chips. Each CPU 76 may be one or more microprocessors, micro-controllers, field programmable gate arrays, or ASICs, while the memory 78 may include RAM, DRAM, SRAM, flash memory, and/or another digital storage medium, and is also typically implemented using circuit logic disposed on one or more physical integrated circuit devices, or chips.

The device 24 and/or 26 may further include radio transceiver circuitry 80 to communicably couple with the transceiver circuitry 22 coupled to the central console 12 or with transceiver circuitry coupled to the unit 28. A power supply 82, such as at least one battery or other energy storage device, may provide the necessary power for the device 24 and/or 26. In some embodiments, each device 24 and/or 26 includes speech recognition/synthesis circuitry 84 (hereinafter, "speech circuitry" 84). The speech circuitry 84 may allow a user 34 to interface with the device 24 and/or 26 and voice a command to handle a call. In particular, the command may allow the user 34 to control the communication between themselves and a patient 38 consistent embodiments of the invention. For example, the speech circuitry 84 may process speech input captured from the microphone 70 and convert at least a portion of that speech input into at least one command for controlling the CPU 76 to handle a call from a patient 28. In some embodiments, the console 12 may also include speech circuitry 84. In alternative embodiments, the device 24 and/or 26 and/or the console 12 may not include speech circuitry 84. As such, the device 24 and/or 26 and/or the console 12 may be configured with program code stored in their respective memory and configured to be executed by a CPU or processing unit thereof to implement speech recognition functionality.

Figure 4:
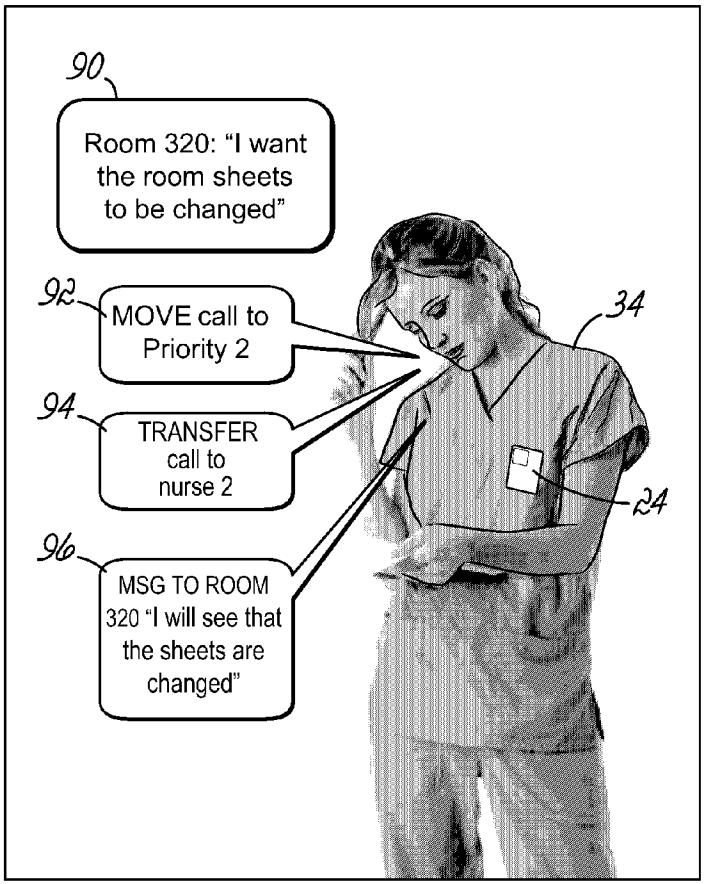
FIG. 4 is a graphic illustration showing various commands and associated speech input that may be utilized to handle a call with the system of FIG. 1.

As illustrated in FIG. 4, a user 34 may receive a call 90 from a patient 38. The call 90 may include speech input captured by a patient communication unit 28 as well as information about the room 50 associated with the patient 38 (e.g., the patient's room) and/or an identity of the patient 38. As illustrated in FIG. 4, the call 90 refers to changing the patient's sheets. While such a request may be tended to by the user 34, it may not be a particularly urgent health issue or patient need. As such, in accordance with one feature of the present invention, the user 34 may prioritize the call 90. Through a voice command 92, such as a "MOVE" command, the user 34 can adjust the priority of the call 90 to a lower priority, such as priority 2 (rather than priority 1), in order to attend to a more urgent call and/or or to allow the user 34 to continue interacting with a patient 38 without being interrupted. For example, and referring to FIG. 5, the user 34 may be interacting with another patient 38 and, by prioritizing and/or re-prioritizing the call 90 using voice commands, the user 34 can finish their current task then respond to lower priority calls. The badge and/or headset device 24 and/or 26 carried by the user 34 may receive the speech input of the user 34 through the microphone 70 then analyze at least a portion of the speech input with speech circuitry 84 to determine whether that speech input is associated with a voice command. If so, the call 90 may be handled consistent with the particular voice command.

In addition to prioritizing and/or re-prioritizing a call 90, the user 34 may utilize a "TRANSFER" command 94 to transfer a call 90 to another user 34 pursuant to a defined line of responsibility or hierarchy. Alternatively, the user 34 may specify the other user 34 that the call 90 should be transferred to. As indicated in FIG. 4, the user 34 may specify that the call 90 is to be transferred to Nurse 2.

Moreover, in accordance with another feature of the invention, the user 34 may receive the call 90 and respond with an appropriate voice message that is played back through the patient communication unit 28 associated with the patient 38 who originated the call 90. In particular, the user 34 may utilize a "MESSAGE" command 96 to capture and supply a reply message to the patient 38 that originated the call 90. In that way, the user 34 may let the patient 38 know that they are responding to their call 90. This may put a patient 38 at ease, as the patient 38 may not be in a particular hurry for a non-urgent request, but would like to know that their call 90 has been received and is being handled.

Through the voice commands 92, 94, 96 and the speech circuitry 84 of the device 24 and/or 26, the user 34 may be able to address how a call is received and handled. If calls are prioritized, they may be attended to in a particular order, as determined by the user 34. Alternatively, the user 34 might pass responsibility for the call to another user 34 through the transfer command 94. Moreover, the user 34 may respond to the call. In some embodiments, this is all done in a hands-free manner while the user 34 attends to other tasks, such as charting or patient care. As noted above, the central console 12 may be aware of the status for each user 34 through information associated with event schedules, real-time activity, and room assignment, so that a line of responsibility might be established for automatic call transfers and call escalations, which may be controlled at the central console 12, as illustrated in FIG. 2, and/or by voice commands from the user 34, as illustrated in FIG. 4. The user 34 may be able to designate a particular user or other healthcare provider to receive a transferred call, or the transfer command may direct the call back to the central console 12, which may handle automatic call transfer based on a hierarchy of responsibility.

Figure 5:
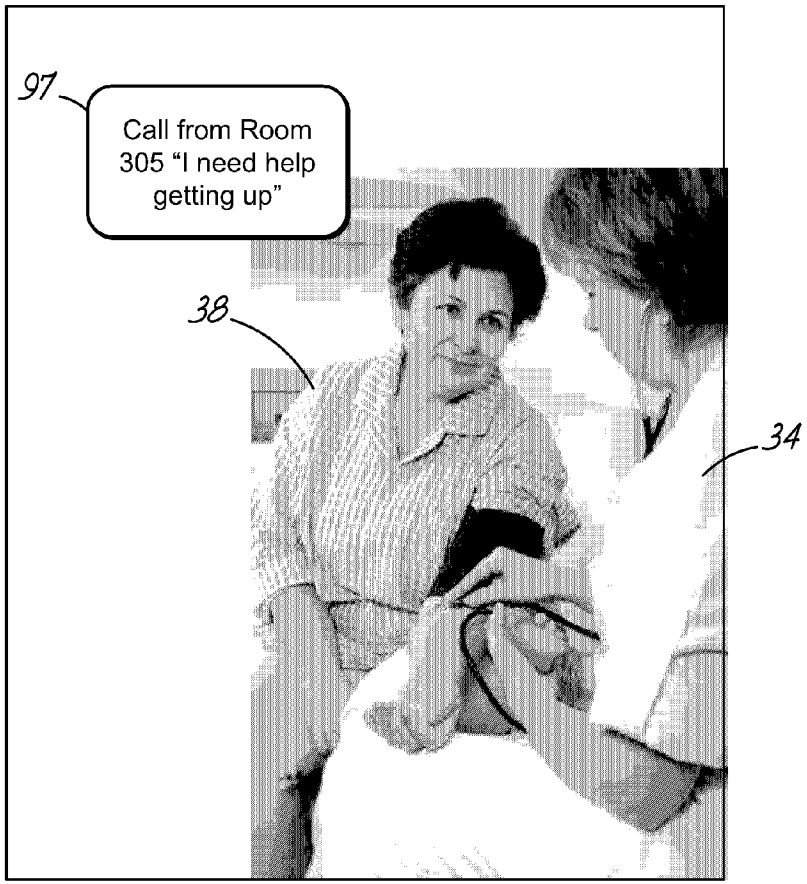
FIG. 5 is a graphic illustration showing various commands and associated speech input that may be utilized to handle a call with the system of FIG. 1.

As illustrated in FIG. 5, certain calls may require immediate attention. For example, a user 34 may be attending to the diagnostics of a first patient 38 and receive a call 97 indicating that a second patient 38 needs help. For example, they might have fallen, or they may need to get up to go to the bathroom, and thus, may require immediate attention. Rather than re-prioritizing or transferring the call, the nurse 34 may respond directly to such urgent calls.

In accordance with another feature consistent with embodiments of the invention, a full duplex voice dialog may be provided between a user 34 and a patient 38. In particular, the full duplex voice dialog may be provided between a device 24 and/or 26 and a patent communication unit 28. As such, the user 34 may utilize a "CONNECT" command (not shown) and specify the patent room 50 and/or patient 38 with whom to communicate with. For example, the nurse may speak, "CONNECT with Patient Room 320" in order for the device 24 and/or 26 to set up a communication channel for a full duplex voice dialog with the patient 38 in room 320. The full duplex voice dialog may be configured to communicate directly to the patient communication unit 28 from the device 24 and/or 26 carried by a user 34 (as at link 44), or to communicate from the device 24 and/or 26 to the patient communication unit 28 through the central console 12 (as at links 36, 30, and/or 32).

Figure 6:
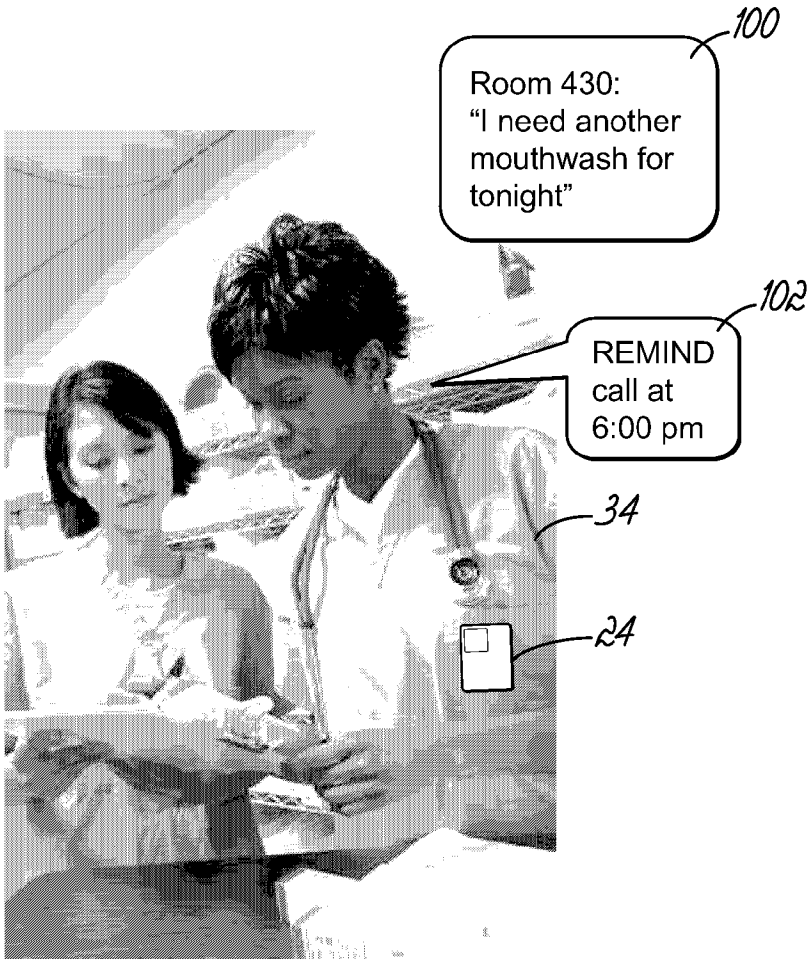
FIG. 6 is a graphic illustration showing various commands and associated speech input that may be utilized to handle a call with the system of FIG. 1.

In accordance with another aspect consistent with embodiments of the invention, and as illustrated in FIG. 6, a call may be postponed rather than being re-prioritized and/or re-prioritized. For example, a call 100 may have to do with an action or regimen that would be most appropriate later in a day, or later in a shift. In particular, the call 100 illustrated in FIG. 6 references a patient 38 needing a mouthwash for a time later in the day. Thus, the user 34 may postpone the action and set a reminder to take such action at a later time. In FIG. 6, user 34 sets a reminder to replay the call 100 at 6:00 P.M., as illustrated by reference numeral 102. Of course, the voice message might be postponed and reminded sooner, or later, with respect to the overall shift of the user 34. At 6:00 P.M., the system 10 may replay the call 100 to the user 34 so that they might appropriately respond, and take the necessary action.

Figure 7:
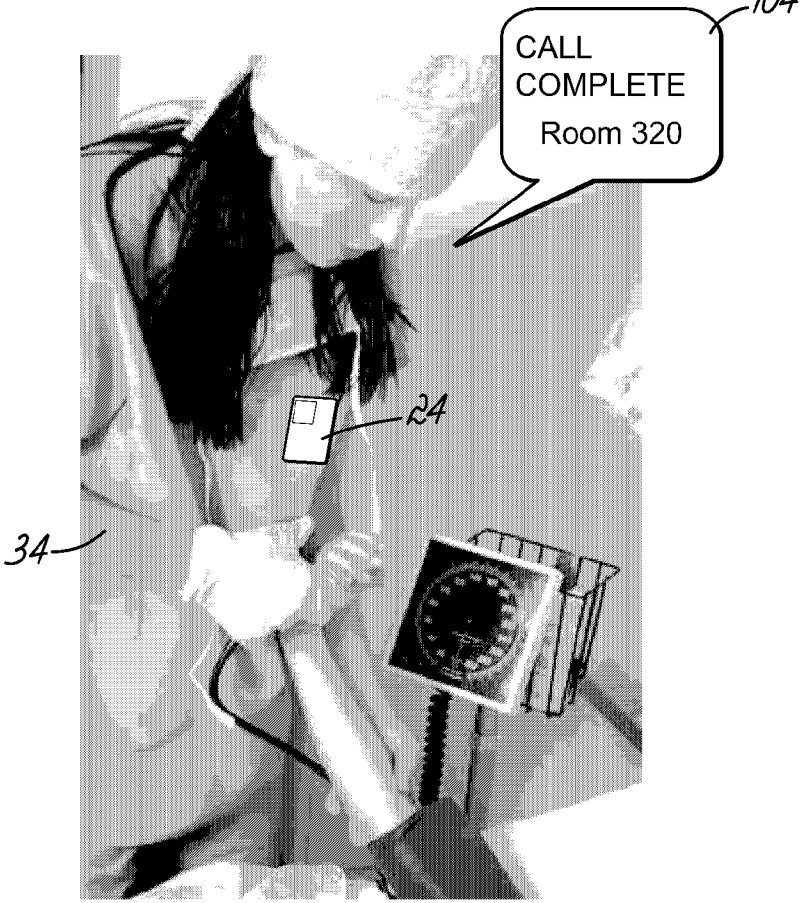
FIG. 7 is a graphic illustration showing various commands and associated speech input that may be utilized to handle a call with the system of FIG. 1.

Once a user 34 has completed in answering a call, the user 34 may indicate as such to close documentation and/or tracking thereof. Referring to FIG. 7, the user 34 may utilize a "CALL COMPLETE" command 104 to indicate that a call sent to the user 34 has been addressed, and has been completed. This, in turn, may update a status associated with the user 34 (e.g., to indicate that the user 34 is now available) and/or a patient 38 consistent with embodiments of the invention. In some embodiments, the central console 12 may automatically update the status in response to receiving the command that a call to a user 34 has been addressed. The room 50 and/or identity of the patient 38 that originated the call might also be associated with the command 104 for reference purposes.

Figure 8:
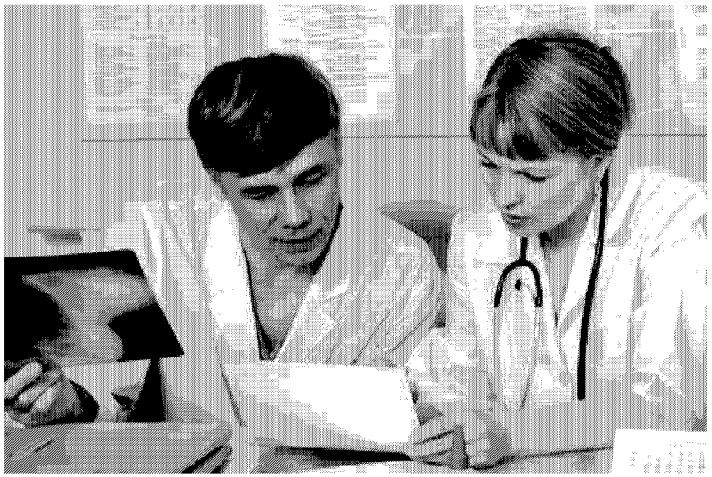
FIG. 8 is an illustration illustrating a feature of the system of FIG. 1.

In accordance with another feature consistent with embodiments of the invention, the device 24 and/or 26, in combination with the central console 12, monitor and record information associated with various stages that are in turn associated with a call. For example, the time a call is generated may be tracked and recorded, along with the time for a response from a user 34 and/or the identity of the user 34 that responds to the call. Additionally, any users 34 that are transferred a call, to from whom a call is transferred, may also be tracked and recorded. Furthermore, the time of completion of a call may also be tracked and recorded, including the time from which the user initially responds to the call to the time at which the call was completed. Other information associated with calls may also be tracked, including the commands spoken by users 34 and information associated with those commands, the room of origin, and/or the patient 38 of origin. For example, the various users 34 who respond to a call, who prioritize or transfer a call, and/or who actually receive the call and must respond to it, and also the responding user 34, may be monitored and recorded. Due to the ability of embodiments of the invention to not only prioritize calls but also transfer them to other users 34, or have them automatically transferred according to a hierarchal priority, a plurality of users 34 may be involved in the timeline from the beginning to completion of a call. All such information associated with the timing of the call and its completion, along with any user 34 involved, may be monitored and recorded for further review of the healthcare providers and management and to provide concrete evidence from a legal perspective and/or billing perspective, as well as to provide information to share with the patient 38 and/or family members, as illustrated in FIG. 8.

In accordance with another feature consistent with embodiments of the invention, speech circuitry 84 of the device 24 and/or 26, speech circuitry 84 that may be alternatively disposed in the central console 12, and/or speech recognition functionality in the form of program code that can be executed by the processing units of the devices 24 and/or 26 and/or control unit 12 to convert speech input of the users 34 and/or patients 38, can provide a particular indication of the urgency of a call as well as the nature of such a call. For example, utilizing speech recognition functionality, the tone, timber, intensity, and/or voice pitch of speech input of a user 34 and/or patient 38 may be determined. From that information, it might be determined that the patient 38 is screaming, yelling, or otherwise making a noise consistent with distress, which may increase the priority and add urgency to the call. Furthermore, the speech recognition functionality may pick out certain words that provide a context to the call, and thus, provide an indication of its urgency. Based on the urgency of such a call, the central console 12 may transfer the call to an appropriate user or department, while simultaneously notifying a primary nurse with the call (e.g., when the central console 12 is configured with such speech recognition functionality). Moreover, a distinct audio tone might be utilized in the call preceding the playback of the speech input of the patient 38 to indicate the acuteness level of that particular call and/or voice message.

Figure 9:
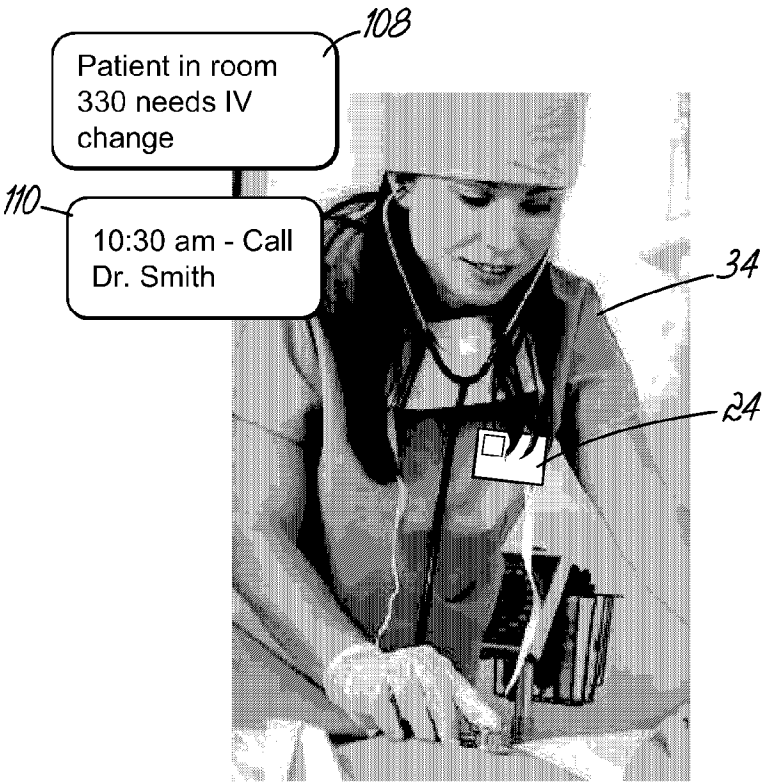
FIG. 9 is an illustration illustrating a feature of the system of FIG. 1.

Turning to FIG. 9, in accordance with another feature consistent with embodiments of the invention, reminders of various care plans and memos can be set. For example, a busy user 34 wearing a device 24 may use voice commands to set care plan reminders and memos to be heard back, at a later time, as voice prompts or voice messages. For example, the user 34 may utilize a "SET REMINDER" command to set a reminder. As such, the user 34 may speak into a badge 24 by noting that they want to, "SET REMINDER," then specify the reminder to set. Speech recognition functionality of the device 24 may capture additional speech input associated with the reminder, and schedule the reminder message for a time also specified by the user 34. For example, reference numeral 108 indicates a reminder to be played for the user 34 for a particular patient care plan associated with a patient 38 in a particular room 50. A time might also be associated and spoken with respect to reminder 108. Similarly, utilizing voice commands, other general memos and reminders may be captured and set to be played back at appropriate times. For example, reference numeral 110 refers to a reminder for the user 34 to call a Dr. Smith at the specified time as set through the voice commands. At the appropriate time, the care plan reminders and memos are played back to the user 34 such that the user 34 can take the appropriate action as indicated. Alternatively, the central console 12 may run a program which provides such reminders and memos to various users 34 at the appropriate times based upon a preset schedule of care plans and tasks to be performed.

Figure 10:
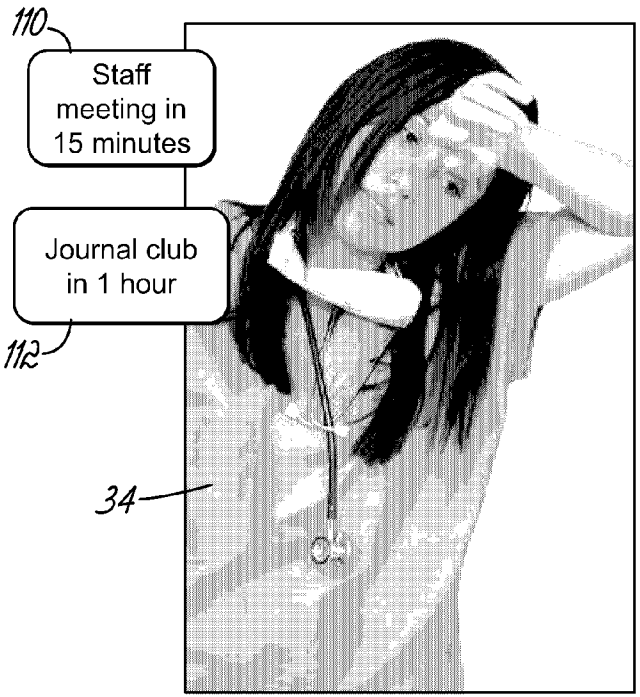
FIG. 10 is an illustration illustrating a feature of the system of FIG. 1.

Embodiments of the invention provide a user 34 with the ability to set vocal reminders and memos to remind them of daily events that may not necessarily be associated with the particular care or care plan in turn associated with a patient 38. For example, as illustrated in FIG. 10, the user 34 may provide a voice command to, "SET REMINDER," then speak a message to indicate a staff meeting at a certain time, as indicated by reference numeral 110. Alternatively, as indicated by reference numeral 112, another voice message may be recorded to be played back at a certain time to remind the user 34 of another event that day. In that way, various daily activity reminders might be set through speech commands to be played back and heard by the user as voice messages at the appropriate times, as indicated. To that end, the command to set a certain reminder might also include a prompt to indicate a time, or the time may be part of the command phraseology.

Figure 11:
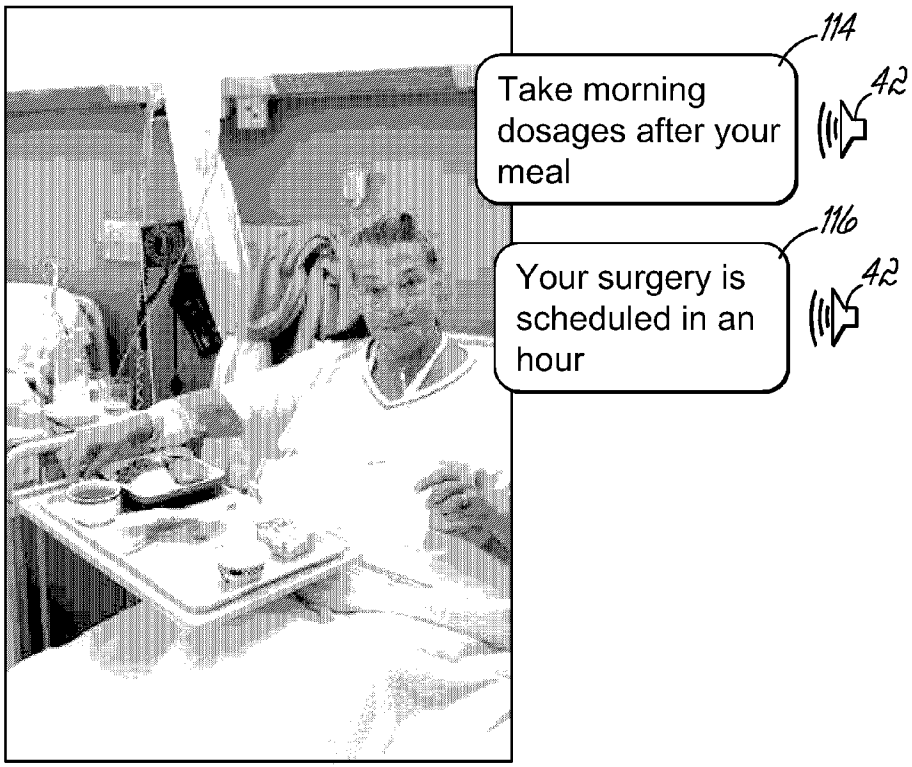
FIG. 11 is an illustration illustrating a feature of the system of FIG. 1.

In accordance with another feature consistent with embodiments of the invention, the central console 12 may run a program that provides pre-set patient self-care reminders and informational voice messages to the patient 38 in their room. The reminders and voice messages may be played through unit 28 in the patient room 50, as illustrated in FIG. 11. For example, a voice message to take a particular dosage of a medicine might be indicated according to reference numeral 114 in FIG. 11. Similarly, a reminder that a surgery is scheduled might also be played as a voice message, as indicated by reference numeral 116. The messages are played from an appropriate speaker 42 of the unit 28. Such patient reminders, as illustrated in FIG. 11, might be scheduled by a user 34 at the central console 12, such as by entering information via a keyboard 18 or mouse 20. Alternatively, a user-carried device 24 and/or 26 might be utilized by a user 34 to set up and provide such reminders. For example, a user 34 may set a reminder through voice commands, and then record the voice message for the reminder and a particular time to schedule the reminder such that the voice message will play at the unit 28 in the patient's room 50 at the specified time. In some embodiments, the voice message may be played concurrently at the device 24 and/or 26, and/or the central console 12 that set up that voice message.

Figure 12A:
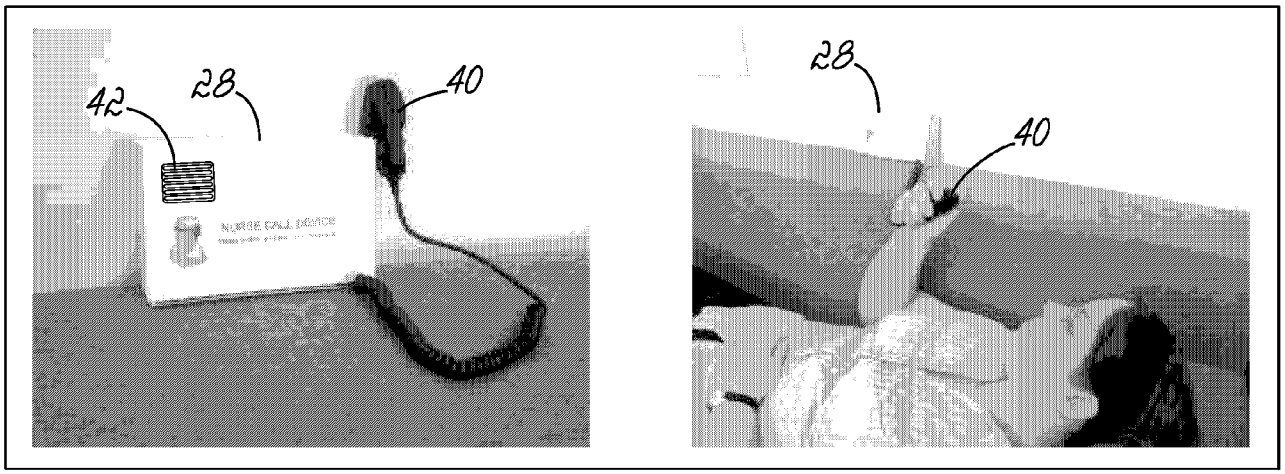
FIG. 12*a* is an illustration of a patient communication unit of FIG. 1.
Figure 12B:
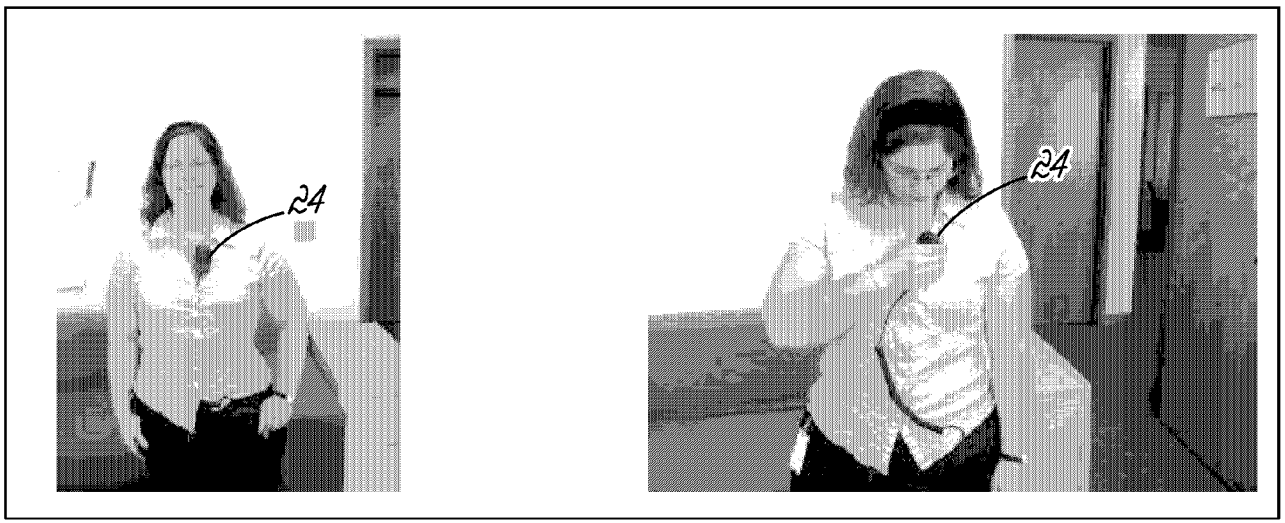
FIG. 12*b* is an illustration of a portable communication unit of FIG. 1.

FIG. 12*a* is a pictorial representation of one possible patient communication unit 28 with a microphone 40 that may be used to capture speech input of a patient 38 and a speaker 42 to play voice messages to the patient 38. FIG. 12*b* illustrates a wearable device 24 that may be in the form of a badge or other wearable device and includes a microphone (not shown in FIG. 12*b*) and a speaker (not shown in FIG. 12*b*) for communications in accordance with embodiments of the invention. As noted above, a headset 26 might also, or alternatively, be utilized (not shown in FIG. 12*b*).

Embodiments of the invention allow a nurse, user, or other care provider to receive patient calls that include patient speech input captured by in-room terminals, and allows the care provider to respond to the appropriate voice messages, wherein the responses may be played back through the same in-room terminal to the patient. The care provider has the ability to prioritize calls, transfer calls to other staff, or escalate calls as appropriate through voice commands in a hands-free manner. Embodiments of the invention also allows the care provider to establish full duplex voice dialog if they see the need to have such communications with the patient. The present invention further allows the care provider to set care plan reminders for a patient, to set and play memos for daily activities such as meetings, etc., and to do all this through voice activation and playback utilizing a user-worn device with speech recognition capabilities. In that way, patients can quickly communicate their requests for help, and the care provider can respond or forward the call appropriately. Embodiments of the invention allow care providers to use their discretion to prioritize more urgent calls without interrupting their work flow and their interactions with other patients.

Figure 13:
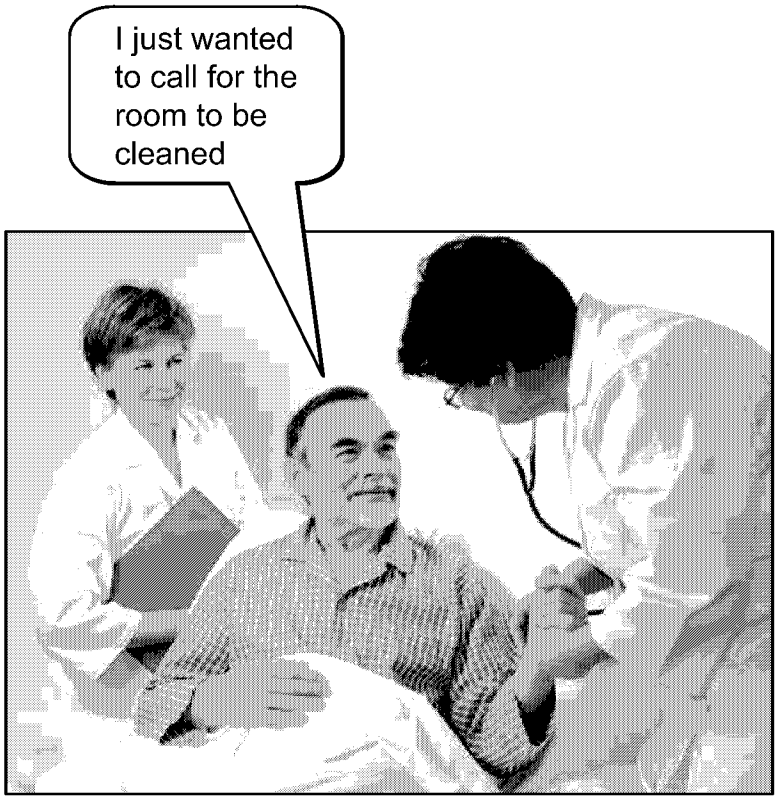
FIG. 13 is an illustration illustrating a feature of the system of FIG. 1.

The central console of the invention is aware of the status of each care provider through information from event schedules, real-time activity, room assignments, and thus embodiments of the invention allow a line of responsibility prioritization for automatic call transfer and call escalations. The central console may be further configured to monitor and record the timing for each event including call generation, the time of response, the time of completion of the call, and the users (e.g., staff) involved so that records may be kept with respect to each call and event, such as for the purpose of legal evidence, billing purposes, as well as patient and/or family information. Furthermore, embodiments of the invention provide pre-set patient self-care reminders (such as medication reminders), and also provides voice notifications to be played to the patient in their room. The in-room terminal provides the necessary speaker for such communications. While a healthcare provider might request such reminders and notifications, the patient can also request any number of care notifications to be set by the healthcare provider. The central console may also have the ability to decipher the urgency and nature of a call request based on the tone of speech and word or speech recognition, and to transfer a call to the appropriate care giver(s) or department, while simultaneously notifying a primary care giver with distinct tones to indicate the acuteness level of the patient voice message. In that way, as illustrated in FIG. 13, patients have a chance to quickly convey their problem, and get an appropriate person to help with their situation. In this way, embodiments of the invention may improve overall patient satisfaction as well as the efficiency of the staff providing care to the various patients within a facility.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of the applicants' general inventive concept.

Other modifications will be apparent to one of ordinary skill in the art. Therefore, the invention lies in the claims hereinafter appended.

What is claimed is:

1. A communication system for care providers comprising:

a patient communication unit configured to be positioned proximate to a patient and operable to capture a patient call that includes speech input of the patient;

a central console communicably coupled with the patient communication unit for receiving the call from the patient communication unit; and a portable communication unit configured to be carried by a care provider and communicably coupled with the central console, the portable communication unit operable to receive the call from the central console, at least one of the central console and the portable communication unit including speech circuitry having a speech recognition functionality that is configured for providing an indication of the urgency of the patient call, the central console configured to transfer the call to a care provider based upon the urgency of the patient call and further configured to evaluate the availability of various care providers and to manage a hierarchy for the call to insure proper delivery of a call to the care providers;

the portable communication unit further configured to capture speech input of a care provider, and to play at least a portion of the patient speech input included in the call, the portable communication unit further operable to convert at least a portion of the care provider speech input into at least one command associated with the call.

2. The system of claim 1, wherein the at least one command includes a command to transfer the call to another care provider, the central console being further operable to transfer the call to the other care provider in response to receiving the command to transfer the call from the portable communication unit.

3. The system of claim 1, wherein the at least one command includes a command to answer the call, the central console being further operable to update a status of the care provider in response to receiving the command to answer the call from the portable communication unit.

4. The system of claim 3, wherein updating the status of the care provider includes indicating that the care provider is not available.

5. The system of claim 1, wherein the at least one command includes a command to respond to the call, the portable communication unit being further operable to transmit at least a second portion of the care provider speech input to the patient communication unit for the patient communication unit to play.

6. The system of claim 5, wherein the portable communication unit is further operable to transmit the second portion of the care provider speech input to the patient communication unit through the central console.

7. The system of claim 5, wherein the portable communication unit is communicably coupled with the patient communication unit, and wherein the portable communication unit is further operable to transmit the second portion of the care provider speech input to the patient communication unit directly.

8. The system of claim 1, wherein the at least one command includes a command to postpone responding to the call, the central console being further operable to provide the call to the portable communication unit a second time.

9. The system of claim 1, wherein the at least one command includes a command to prioritize the call, the central console being configured to adjust a priority of the call.

10. The system of claim 1, wherein the at least one command includes a command to set a reminder.

11. The system of claim 10, wherein the at least one command includes a command to play the reminder back to the care provider.

12. The system of claim 1, wherein the at least one command includes a command to create a patient memo, the portable communication unit being further operable to record at least a second portion of the care provider speech input as the patient memo and provide the patient memo to the patient communication unit for the patient communication unit to play.

13. The system of claim 1, wherein the central console is further operable to determine the status of the care provider in response to receiving the call, and provide the call to the portable communication unit associated with the care provider in response to determining that the care provider is available.

14. The system of claim 1, wherein the central console is further operable to determine information associated with the care provider in response to receiving the call, and provide the call to the portable communication unit associated with the care provider in response to determining that the care provider is associated with the patient.

15. The system of claim 1, wherein the central console is further operable to determine at least one of a room associated with the patient or an identity of the patient, and provide the at least one of the room or the identity to the portable communication unit with the call.

16. A method of managing patient care with a communication system for care providers, comprising:

receiving, at a central console, a patient call captured by a patient communication unit, the call including speech input of a patient;

transmitting the call to a portable communication unit associated with a care provider;

using speech recognition for providing an indication of the urgency of the patient call and transferring the call to a care provider based upon the urgency of the patient call;

evaluating the availability of various care providers to manage a hierarchy for the call to insure proper delivery of a call to the care providers;

the portable communication unit configured to play at least a portion of the patient speech input included in the call; and capturing speech input of the care provider with the portable communication unit, wherein at least a portion of the care provider speech input is converted into at least one command associated with the call.

17. The method of claim 16, wherein the at least one command includes a command to transfer the call to another care provider, the method further comprising:

in response to the central console receiving the command to transfer the call, transferring the call to another care provider.

18. The method of claim 16, wherein the at least one command includes a command to answer the call, the method further comprising:

in response to the central console receiving the command to answer the call, updating a status of the care provider to indicate that they are answering the call.

19. The method of claim 18, wherein updating the status of the care provider further comprising:

indicating that the care provider is not available.

20. The method of claim 16, wherein the at least one command includes a command to respond to the call, the method further comprising:

transmitting at least a second portion of the care provider speech input from the portable communication unit to the patient communication unit for the patient communication unit to play.

21. The method of claim 20, wherein the second portion of the care provider speech input is transmitted through the central console.

22. The method of claim 20, wherein the second portion of the care provider speech input is transmitted directly from the portable communication unit to the patient communication unit.

23. The method of claim 16, wherein the at least one command includes a command to postpone responding to the call, the method further comprising:

determining, from the at least a portion of the care provider speech input, a time to which to postpone the call; and upon reaching the time, transmitting the call to the portable communication unit a second time.

24. The method of claim 16, wherein the at least one command includes a command to set a reminder, the method further comprising:

determining, from the at least a portion of the care provider speech input, a time at which to play the reminder;

recording, from at least a second portion of the care provider speech input, the reminder; and playing the recorded reminder at the determined time.

25. The method of claim 16, wherein the at least one command includes a command to create a patient memo, the method further comprising:

recording, from at least a second portion of the care provider speech input, the memo; and transmitting the memo from the portable communication unit to the patient communication unit for the patient communication unit to play.

26. The method of claim 16, further comprising:

in response to receiving the call, determining a status of the care provider, wherein transmitting the call to the portable communication unit associated with the care provider is performed in response to determining that the care provider is available.

27. The method of claim 16, further comprising:

in response to receiving the call, determining information associated with the care provider, wherein transmitting the call to the portable communication unit associated with the care provider is performed in response to determining that the care provided is associated with the patient.

28. The method of claim 16, further comprising:

in response to receiving the call, determining at least one of a room associated with the patient or an identity of the patient; and providing at least one of the room or the identity to the portable communication unit with the call.

* * * * *